United States Patent [19]

Jansma et al.

[11] Patent Number: 4,877,040

[45] Date of Patent: Oct. 31, 1989

[54] CIGARETTE HOLDER WITH FILTER MODIFIER, AND RELATED METHOD

[75] Inventors: Donald Jansma, Grand Rapids, Mich.; Howard W. Stemm, Lenexa, Kans.

[73] Assignee: Bissell Health Care Corporation, Grand Rapids, Mich.

[21] Appl. No.: 179,287

[22] Filed: Apr. 8, 1988

Related U.S. Application Data

[63] Continuation-in-part of Ser. No. 42,326, Apr. 24, 1987, abandoned.

[51] Int. Cl.[4] ..... A24D 3/04

[52] U.S. Cl. ..... 131/189; 131/188; 131/338; 131/339

[58] Field of Search ..... 131/338, 189, 188, 339

[56] References Cited

U.S. PATENT DOCUMENTS 683,234 9/1901 Thompson .
987,823 3/1911 Perry .
1,883,701 10/1932 Goldberg .
2,532,531 12/1950 Angert .
2,778,364 1/1957 Nagle .

FOREIGN PATENT DOCUMENTS 215544 5/1924 United Kingdom .

*Primary Examiner*—Vincent Millin
*Attorney, Agent, or Firm*—Price, Heneveld, Cooper, DeWitt & Litton

[57] ABSTRACT

The specification discloses a cigarette filter modifier and related method in which the pattern of tar and nicotine collection in a conventional cigarette filter is modified by the insertion into the filter of a hollow probe having laterally opening apertures therein which communicate with the interior passageway of the probe, combined with a base shield radiating from and surrounding said probe so as to block the passage of smoke, thereby forcing cigarette smoke to travel through the apertures and interior passageway of said probe. The probe apertures are located so that they open laterally with respect to the length of the probe.

40 Claims, 2 Drawing Sheets

CIGARETTE HOLDER WITH FILTER MODIFIER, AND RELATED METHOD

CROSS REFERENCE TO RELATED APPLICATION

This is a continuation-in-part of U.S. patent application Ser. No. 07/042,326 filed Apr. 24, 1987 now abandoned and entitled "CIGARETTE HOLDER WITH FILTER MODIFIER, AND RELATED METHOD," which is expressly abandoned upon the filing of this application. Some of the claims of this application are generic to U.S. patent application Ser. No. 07/042,325 filed Apr. 24, 1987 now abandoned and entitled "CIGARETTE FILTER MODIFIER AND METHOD."

BACKGROUND OF THE INVENTION

The present invention relates to cigarette filtering devices. Many cigarettes are sold with an integral filter Such filters typically comprise a short length of fibrous material located behind the tobacco portion of the cigarette. As the user draws on the cigarette, smoke passes through the fibrous material of the integral filter whereby tars and nicotine are at least partially filtered out of the smoke.

There are cigarette holders on the market which further filter tars and nicotine from the smoke leaving a cigarette, even a cigarette which already includes an integral filter. One such holder defines a tortuous path through which the smoke must travel before it reaches the smoker's mouth. It removes as much as 30% of the tars and nicotine which manage to escape the integral cigarette filter and which would otherwise reach the smoker's mouth. Another holder utilizes a moistened cellulose acetate material to filter the smoke.

One problem with such filtering cigarette holders is that they are very noticeable when used. Also, they alter the draw characteristics of the cigarette. As a result, only a small percentage of smokers use such devices, even though they would benefit from such use in terms of reduced tar and nicotine intake.

SUMMARY OF THE INVENTION

The present invention is believed to comprise the first filter modifying device. Rather than merely serving as a secondary filter, the device of the present invention actually modifies the filtering characteristics of conventional integral cigarette filters. Since it modifies the integral cigarette filter itself, rather than merely comprising a separate secondary filter, it can be very compact, unobtrusive and substantially unnoticeable.

In the method and device of the present invention, a probe is provided which extends forwardly from a base shield for insertion into an integral cigarette filter. The probe includes at least one aperture opening laterally outwardly with respect to the length thereof in order that smoke entering the aperture has to make a sharp turn in order to be drawn into the interior of the probe. Each aperture must be less than about 0.1 inch in length along the longitudinal axis of the probe, preferably less than about 0.075 inches, and the overall aperture area must be less than about 0.0135 square inches and preferably less than about 0.0080 square inches. An interior passageway communicates with the probe aperture and extends therefrom through the probe and through the base shield. The cross-sectional area of the interior passage should be no more than about 0.008 square inches, and preferably no more than about 0.006 square inches. The base shield is at least approximately as large in diameter as the diameter of conventional cigarette filters so as to block the passage of smoke through the end of the integral filter and force smoke to travel instead through the aforesaid probe aperture and interior passageway when the smoker draws on the cigarette.

Use of this device, especially in its more preferred embodiments, removes up to about 60% or more of the tars and nicotine which would otherwise pass through a conventional integral cigarette filter and go directly to the smoker's mouth, throat and lungs. It also draws naturally and is unobtrusive in appearance. These and other features, objects and advantages of the invention will be more fully understood and appreciated by reference to the written specification and appended drawings.

DESCRIPTION OF THE PREFERRED EMBODIMENT

Figure 1:
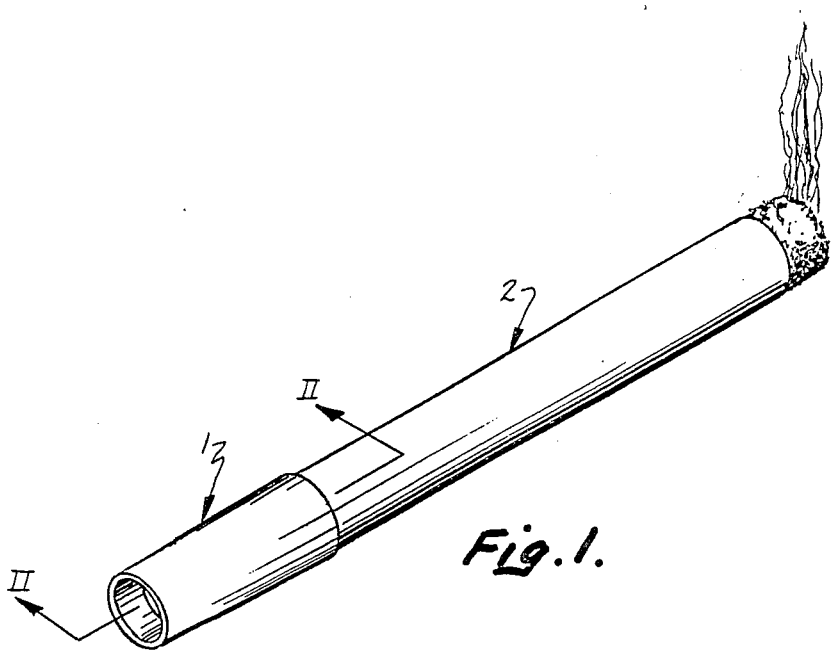
FIG. 1 is a perspective view of the filter modifying device of the present invention with a cigarette inserted therein.
Figure 2:
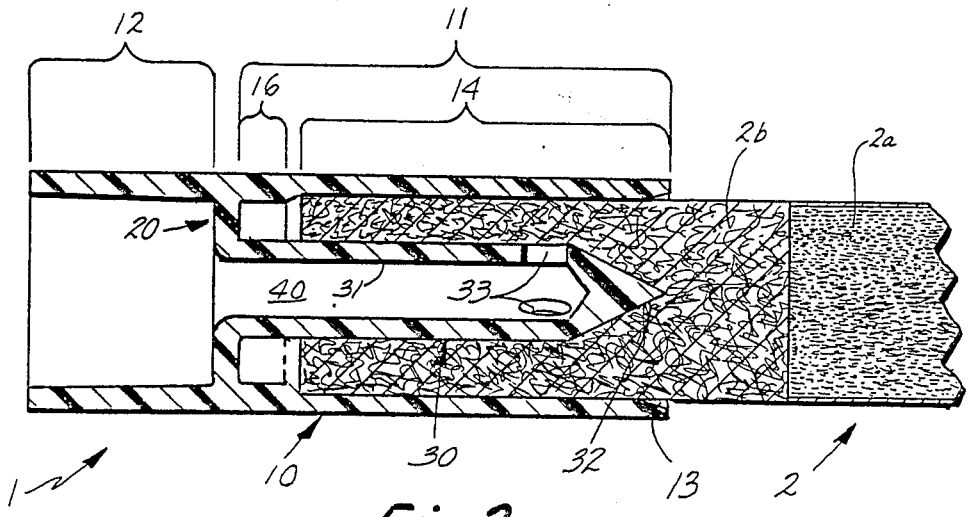
FIG. 2 is a cross-sectional view taken generally along plane II—II of FIG. 1.
Figure 3:
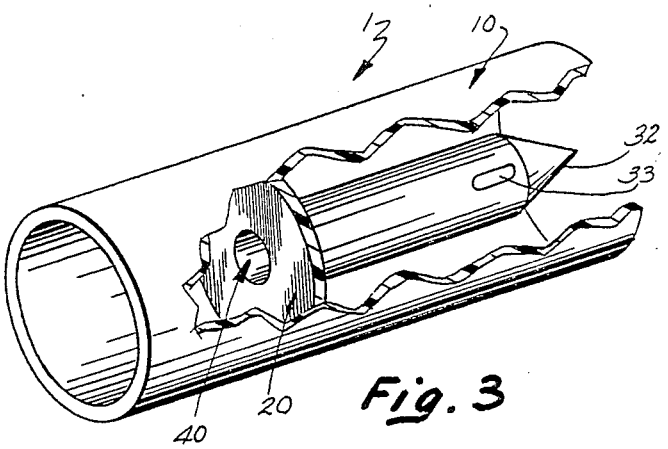
FIG. 3 is a broken, partially cross-sectional view of the device of the present invention.

In the preferred embodiment, filter modifier 1 comprises an outer cylindrical wall 10 for receiving a conventional cigarette 2 including a tobacco portion **2*a* and an integral filter portion 2*b* (FIGS. 1 and 2). Located within and surrounded by cylindrical wall 10 is a base shield 20 which includes a probe 30 extending forwardly therefrom for insertion into integral filter 2*b* (FIGS. 1, 2, 3 and 5). Probe 30 includes three apertures 33 communicating with the interior thereof and an interior passageway 40 extending from probe apertures 33 rearwardly to and through base shield 20. Base shield 20 itself blocks the passage of smoke, whereby smoke must travel through apertures 33 and passageway 40 to reach the user's mouth. This alters the flow characteristics of integral filter 2*b*** and facilitates the surprisingly improved filtering results discussed above in the Summary of the Invention.

Filter modifier 1 is preferably integrally molded of a sturdy plastic material. Outer cylindrical wall 10 includes a holder portion 11 projecting forwardly from base wall 20 and a mouthpiece portion 12 extending rearwardly therefrom. Mouthpiece portion 12 extends rearwardly from base wall 20 so that base wall 20 is recessed away from the smoker's tongue. Holder portion 11 comprises first and second segments 14 and 16 respectively which are of differing diameters for receiving the two different diameter cigarettes commonly sold today. First segment 14 is joined to narrower diameter second segment 16 by a short tapered step 15. First segment 14 accommodates conventional larger diameter cigarettes. Narrower second holder segment 16 accommodates the so-called "slim" cigarettes. First segment 14 includes a tapered interior leading edge 13 which facilitates insertion of cigarette 2 into holder 11.

Base shield 20 comprises an annular disk integral with and extending inwardly from outer cylindrical wall 10. Base shield 20 is solid and is as large in diameter as approximately the diameter of a cigarette so as to block the passage of smoke from the cigarette to the user's mouth (FIGS. 1–5). In this regard, it should be noted that when device 1 is used with a larger cigarette, tapered step wall 15 and second holder segment 16 act functionally as part of shield 20 in that they also act to block the passage of smoke out of the end of integral filter 26.

Probe 30 which extends forwardly from base shield 20 comprises a generally cylindrical sidewall 31 which terminates at a cone-shaped tip 32 at the end thereof. There are three probe apertures 33 spaced equidistant around the circumference of probe sidewall 31 in the vicinity of the front tapered portion. This arrangement is preferable in that it provides sufficient openings to facilitate an easy draw on the cigarette, and yet results in each apertures 33 being located opposite a solid portion of sidewall 31. It is also important that each apertures 33 open laterally outwardly with respect to the length of sidewall 31 in order that smoke entering each apertures 33 has to make a sharp turn in order to be drawn into the interior passageway 40 of filter modifier 1. In this way, tar and nicotine particles which are drawn laterally into the interior of passageway 40 tend to be accelerated towards the opposite solid wall portion of sidewall 31 where they tend to stick and collect on the interior thereof rather than be carried into the user's mouth and lungs. In contrast, if apertures 33 opened forwardly towards the point 32 of probe 30, smoke and air would tend to be drawn into passageway 40 in a longitudinal line and would have less tendency to be thrown against sidewall 31 of probe 30. Similarly, if two apertures 33 were located directly opposite one another, there would be a tendency for the smoke and air flow from each to mix and travel down the center of passageway 40, rather than be accelerated against an opposite solid wall portion of sidewall 31. Hence, making apertures 33 laterally opening and orienting apertures 33 such that each is located opposite a solid portion of sidewall 31 are most preferable embodiments of the invention.

Further, it is preferable that apertures 33 be located towards the front end 32 of probe 30. This allows for more tar and nicotine buildup on the inside of probe sidewall 31 before filter modifier 1 has to be thrown away. While the overall operation of modifier 1 in removing contaminates is slightly better when apertures 33 are located closer to base shield 20, it is preferred to locate apertures 33 forwardly to render modifier 1 more reuseable and minimize the possibility of tars oozing out of the end of passageway 40 into the user's mouth. However, apertures 33 should preferably not open into cone area 32 as this would make them longitudinally opening rather than laterally opening, allowing them to draw smoke in without forcing it to turn.

Apertures 33 should be sufficiently large as to facilitate a relatively easy draw on the cigarette. However, each aperture should be no more than about 0.1 inch in length along the longitudinal axis of probe 30, and more preferably should be no more than about 0.075 inches in length. If apertures 33 are too long along the length of probe 30, it becomes too easy for smoke to pass generally longitudinally through the apertures rather than being forced to make a sharp turn entering each aperture and make another sharp turn to travel down the length of passageway 40. Further, the overall cross-sectional area of apertures 33 should be no more than about 0.0135 square inches and preferably no more than about 0.0080 square inches. Most preferably, this area is divided between three separate apertures 33, rather than being concentrated in one aperture.

The cross-sectional area of passageway 40 also must be sufficiently great to allow for easy draw. However, it should be no more than about 0.008 square inches and preferably no more than about 0.006 square inches, most preferably about 0.004 square inches. If the cross-sectional area becomes too great, there is less tendency for contaminate particles to be forced against a passage sidewall and be removed by adherence thereto. Experimental data reveals that at a passageway cross-sectional area of 0.008 square inches, device 1 removes approximately half the contaminates that are removed when the cross-sectional area of passageway 40 is 0.004 square inches.

Probe 30 passageway 40 which extends from apertures 33 rearwardly to and through base shield 20. Passageway 40 tapers inwardly as one proceeds forwardly along the length of probe 30, again facilitating molding. Similarly, all of the wall sections of device and probe 30 taper outwardly towards base wall 20 to facilitate ease of molding. The taper need only be slight and is not noticeable in the drawings.

The length of probe 30 is such that it will extend into integral filter **2*b*, whether a regular diameter cigarette is used or a so-called slim cigarette is used, but not so long as to project completely through integral filter 2*b* when a slim cigarette is used. Holder portion 11 is just slightly longer. The length of probe 30 is preferably about three-quarters of the length of a typical cigarette filter, thereby locating the apertures 33 at a point about two-thirds down the length of filter 2*b* towards the cigarette tobacco portion 2*a* of the cigarette. This allows a portion of the existing filter 2*b* to filter some of the smoke before it enters filter modifier 1. Yet, it leaves a substantial length of interior passageway 40 to collect tar and nicotine along the interior sides of probe sidewall 31**.

In a best mode, probe 30 is about 0.6 to 0.7 inches long and holder portion 11 is about 0.7 inches long. Apertures 33 are located to start at about 0.4 inches up the length of probe 30 from base shield 20. They are about 0.03 to 0.04 inches wide and about 0.07 to 0.08 inches long. The diameter of passageway 40 is about 0.071 inches, for a cross-section of about 0.004 square inches. Mouthpiece 12 projects rearwardly from disk 20 about 0.3 inches. Shield 20 is about 0.28 inches in diameter, as is second holder segment 16, while first holder segment 14 is about 0.3 inches in diameter at its base.

Figure 4:
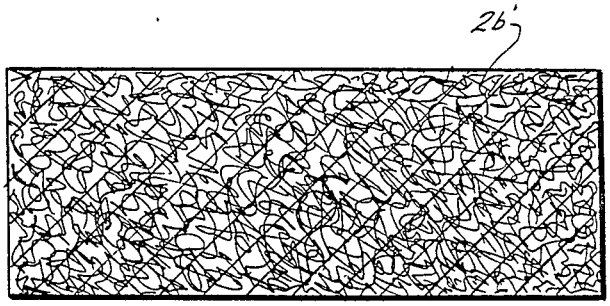
PRIOR ART Fig. 4.
FIG. 4 is a longitudinal cross-sectional view of a conventional integral cigarette filter darkened to illustrate the pattern of tar and nicotine collection in the filter.
Figure 5:
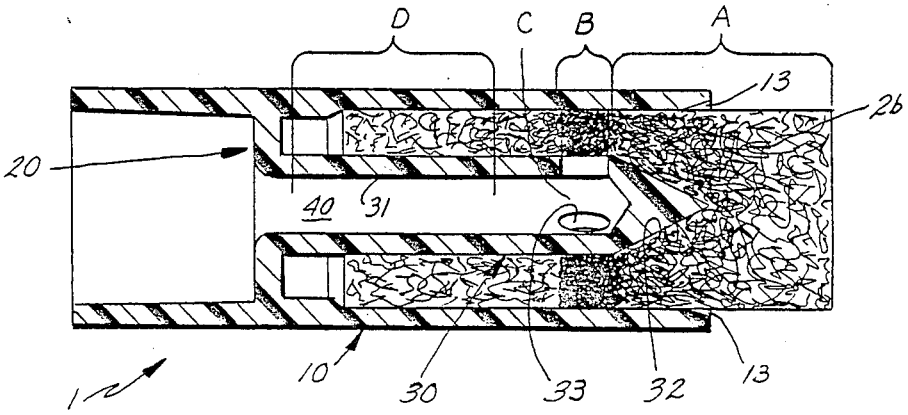
FIG. 5 is a longitudinal cross-sectional view of a conventional cigarette filter after having been used in conjunction with the device of the present invention, darkened so as to illustrate the tar and nicotine collection pattern of the filter.

FIGS. 4 and 5 compare the tar and nicotine collection pattern for two conventional integral cigarette filters **2*b*' and 2*b* respectively. Filter 2*b*' of FIG. 4 shows the uniform tar and nicotine collection pattern obtained when one does not use filter modifier 1 of the present invention. On the other hand, filter 2*b* shown in FIG. 5 illustrates the significantly altered tar and nicotine collection pattern when filter modifier 1 of the present invention is inserted into a conventional integral cigarette filter. In the end of the filter in front of probe apertures 33** (area A), a fairly uniform tar and nicotine collection pattern develops comparable to, but perhaps somewhat heavier than, that seen in filter 2b'. However at the location of apertures 33 (area B), a very heavy concentration of tar and nicotine begins to appear. Within the interior passageway 40 of filter modifier 1, one sees a heavy buildup of tar and nicotine in the area C of the inside of probe sidewall 31 which is opposite one of-the aperture openings 33 (not shown). The deposit of tars and nicotines continues down the length of the interior of probe 30 (area D). As a result of this altered tar and nicotine deposit pattern in filter 2b, and as a result of tar and nicotine deposit on the inside wall of probe 30, up to 60% or more tar and nicotine is removed than would be the case with filter 2b' used without filter modifier 1 of the present invention.

The reasons for the surprising improvement in filter performance when the present invention is used are not known for certain. However, it is believed that by embedding apertured probe 30 within fibrous filter 2b, smoke passing through filter 2b is forced to turn inwardly toward probe 30 and pass laterally through fibrous filaments which are oriented longitudinally of filter 2b. This is believed to result in enhanced collection of tars and nicotines on the fibers.

Further, it is believed that by forcing the smoke to concentrate in order to enter the relatively small apertures 33 (compared to the overall cross-sectional diameter of filter 2b), tars and nicotine are forced to "bunch up." Because they are sticky materials, they tend to agglomerate into larger tar and nicotine particles which are more easily filtered by the fibrous filter material in the vicinity of apertures 33.

In this regard, it is important that apertures 33 have a relative small cross-sectional area as compared with the overall cross-sectional area of filter 2b. This result follows by placing the apertures in probe 30, since the apertures have to be relatively small in order to be located in probe 30. By using three apertures instead of one, each of the apertures can be a little smaller to enhance tar and nicotine collection at each, while leaving the combined cross-sectional area of all three apertures sufficiently large that the draw of the cigarette is not substantially restricted by the use of device 1. It is known that the aperture dimensions given above operate very well to enhance filtration without detracting from the draw of the cigarette. Those skilled in the art will find it easy to experiment with aperture size variations if desired.

In addition to the foregoing, the relatively small cross-sectional area of the apertures 33 as compared to the overall flow area of filter 2b causes air and smoke to accelerate as it enters the vicinity of apertures 33. This acceleration may also have an impact on the enhanced filtration achieved by device 1 in that the inertia of tar and nicotine components may cause them to be "left behind" to be trapped by the fibrous filter material.

Once the tar and nicotine particles are accelerated into the interior of probe 30, they tend first to be accelerated against the opposite interior sidewall portion where they tend to stick to the sidewall 31 of passageway 40. They then continue to collect on the remainder of interior sidewall 31 as one proceeds towards base shield 20. This collection of tar and nicotine particles on the interior sidewall 31 of probe 30 is believed to be a contributing factor in reducing the tar and nicotine content that eventually reaches the user's mouth.

Another surprising result of use of the present invention is that carbon monoxide levels reaching the user are reduced. Up to 50% of the carbon monoxide which would otherwise reach the user is removed if the end of filter 2b is 100% sealed by base shield 20. Fifteen to 20% of the carbon monoxide is removed if base shield 20 covers only 85 to 90% of the end of filter 2b. The reasons for this surprising reduction in carbon monoxide passage have not yet been explained.

All of the foregoing possible explanations are somewhat theoretical. What is known for certain is that device 1 in accordance with the present invention substantially enhances the filtration characteristics of conventional fibrous filters, removing as much as 60% or more of tars and nicotine which would otherwise pass through such filters.

In yet another embodiment of the present invention, the interior passageway 40 of probe 30 is itself filled with a secondary filtering medium. This secondary medium could be a fibrous material such as the cellulose acetate fibers used in typical cigarette filters It could be water impregnated cellulose acetate fibers or fibrous material. It could involve the modification of passageway 40 to make it more tortuous. The term "secondary filtering medium" is used herein in relationship to placing same within interior passageway 40 is intended to include any of the foregoing or other similar variations.

EXPERIMENTAL RESULTS

Experimental work conducted by the Tobacco and Health Research Institute of the University of Kentucky reveals that filter modifiers of the present invention remove up to 60 to 80% of the tars and nicotine which would otherwise pass through to the smoker. Even more surprising, up to 50% of the carbon monoxide which would have otherwise passed through to the smoker were for some unexplained reason removed.

The importance of laterally opening probe apertures rather than longitudinally opening probe apertures can be seen by comparing Tables 1 and 2 below. Table 1 comprises a comparison of a control cigarette without filter modifier to the same control cigarette with a modifier responding to claim 1 herein except for having probe apertures which open longitudinally with respect to the probe axis. Three such apertures, equidistantly spaced, were located towards the front of the probe so as to open longitudinally through a forwardly tapering cone. The reference cigarette used is produced by or for the Tobacco and Health Research Institute and is a filter cigarette designated "2R1F." In all tests, the cigarettes were smoked by a standard apparatus which smoked the cigarettes to a 30 millimeter butt length and recorded total particulate material, nicotine, water, tar and carbon monoxide passing through the cigarette in milligrams per cigarette.

In the Table 1 test, all 20 ports of the test apparatus were first filled with reference cigarettes only as a control. The results are reported in the top line under the heading "Control." Then in two separate runs, half of the 20 ports were filled with reference cigarettes only and the other half were filled with reference cigarettes which included the cigarette filter modifier having longitudinally opening apertures. In the second run, the same combination was tested, but the ports selected were reverse. The results of the two runs were averaged and line two reports the average total particulate material, nicotine, water, tar and carbon monoxide collected in milligrams per cigarette for the reference cigarettes without the filter modifier, while line three provides the same information for reference cigarettes using the filter modifier with longitudinally opening apertures. As can be seen by a comparison of the results, there is no substantial improvement in total particulate matter removed, nicotine removed, tar removed or carbon monoxide removed when the longitudinally opening apertured filter modifier was used as compared to the reference cigarettes without the filter modifier.

TABLE 1

| | | TPM MG/CIG | NIC MG/CIG | WATER MG/CIG | TAR MG/CIG | PUFF COUNT | CO MG/CIG |
|---|---|---|---|---|---|---|---|
| 1. Control 2R1F 30 MM BL | average | 26.04 | 1.529 | 2.655 | 21.99 | 10.02 | 22.05 |
| | Std. dev. | 0.71 | 0.152 | 0.263 | 0.68 | 0.23 | 0.93 |
| 2. 2R1F without filter modifier | average | 25.935 | 1.587 | 2.525 | 21.823 | 9.928 | 23.436 |
| | Std. dev. | 0.976 | 0.099 | 0.382 | 0.892 | 0.247 | 1.390 |
| 3. 2R1F with filter modifier having longitudinally opening apertures | average | 27.379 | 1.622 | 2.760 | 22.996 | 9.958 | 23.323 |
| | Std. dev. | 1.253 | 0.082 | 0.354 | 1.068 | 0.285 | 0.971 |

In contrast, Table 2 below compares two control runs with two runs using filter modifiers made in accordance with claim 1 herein and having laterally opening apertures. In the Table 2 tests, two separate runs of the multi-port smoking apparatus were conducted, each including control reference cigarettes with no filter modifier and including control cigarettes with the filter modifier of claim 1. There were three equidistantly spaced apertures opening laterally and located toward the front of the probe. The percent contaminant removal is reported in the bottom two lines of Table 2. With respect to the controls, 82% (run one) and 70.6% (run two) respectively of total contaminants were removed by using the filter modifiers of claim 1. Nicotine removal was 83% and 77%. Tar removal was 82% and 67%. Carbon monoxide removal was 64% and 52%. These striking, surprising results illustrate the importance of locating the probe apertures so that they open laterally with respect to the length of the probe of the filter modifier.

TABLE 2

| | | TPM MG/C | NIC MG/C | WATER MG/C | TAR MG/C | PUFF /C | % CO MG/C |
|---|---|---|---|---|---|---|---|
| RUN 1 Control | average | 22.68 | 1.55 | 1.20 | 19.92 | 8.14 | 19.88 |
| | std. dev. | 0.75 | 0.09 | 0.11 | 0.77 | 0.24 | 0.23 |
| RUN 2 Control | average | 24.39 | 1.55 | 1.90 | 20.94 | 8.99 | 22.30 |
| | std. dev. | 0.14 | 0.05 | 0.20 | 0.11 | 0.01 | 0.94 |
| RUN 1 Filter modifier of claim 1 | average | 4.04 | 0.26 | 0.19 | 3.59 | 11.11 | 7.22 |
| | std. dev. | 1.54 | 0.12 | 0.05 | 1.37 | 0.49 | 1.25 |
| RUN 2 filter modifier of claim 1 | average | 7.16 | 0.36 | 0.28 | 6.52 | 11.20 | 10.80 |
| | std. dev. | 2.09 | 0.14 | 0.08 | 1.87 | 0.05 | 0.24 |
| RUN 1 | % different from control | 82% | 83% | | 82% | | 64% |
| RUN 2 | % different from control | 70.6% | 77% | | 67% | | 52% |

The importance of aperture configuration and area, and of cross-sectional internal passageway area can be seen by reference to Tables 3–6. Each Table reports results for different runs of the smoking apparatus discussed above. In each run, some of the ports of the apparatus were occupied by reference cigarettes without filter modifiers (control). The results for the control filter cigarettes are indicated on the first line of each Table. Below that, the results are reported for a reference cigarette modified by a filter modifier. Each of the filter modifiers responds to claim 1 herein, except that in some instances aperture areas are outside of the limitations of claim 1. The percent difference in removal as compared to the control filter cigarette alone is also indicated in each Table with respect to each filter modifier tested. "NC" indicates "no change."

Referring to Table 3, filter modifier number 1 includes a probe having six apertures instead of three, each aperture being 0.034 inches wide, 0.075 inches long and having an area of approximately 0.00255 square inches. The apertures were arranged in pairs, one in front of the other along the length of probe 30. The total aperture area as a result of this arrangement was approximately 0.0150 square inches. This area is greater than the approximately 0.0135 square inches which is the maximum set forth in claim 1. As can be seen by reference to Table 3, filter modifier number 1 was not effective to any significant degree in removing contaminates.

Filter modifier number 2 (also Table 3) was identical to filter modifier number 1, except that apertures 33 were staggered. There were three apertures in each row, spaced equidistant around the surface of probe 30. The first row of three was located as illustrated in the drawings herein and the second row of three was located just behind the first row along the length of probe 30, but with its apertures offset 60 degrees from the apertures in the first row. Again, the overall aperture area was about 0.015 square inches, greater than the 0.0135 square inches called for in claim 1. Filter modifier number 2, like filter modifier number 1, showed almost no improvement in contaminate removal as compared to a control filter cigarette with no filter modifier.

TABLE 3

CONTROL FOR FILTER MODIFIERS #1 AND #2
2R1F
30 MM BL

| | TPM MG/C | NICO MG/C | WATER MG/C | TAR MG/C | PUFFS /C | % CO BUTT NIC MG/C | % CO BUTT NIC MG/C |
|---|---|---|---|---|---|---|---|
| Average | 24.46 | 1.715 | 1.368 | 21.37 | 9.31 | 22.94 | 1.061 |
| Std. dev. | 1.12 | 0.065 | 0.310 | 1.03 | 0.17 | 1.27 | 0.082 |
| FILTER MODIFIER #1 | | | | | | | |
| Average | 24.72 | 1.704 | 1.206 | 21.60 | 9.64 | 20.58 | 0.844 |
| Std. dev. | 1.15 | 0.067 | 0.218 | 1.01 | 0.42 | 0.83 | 0.125 |
| % Difference to control | NC | .6% | 11.8% | NC | | 10.3% | |
| FILTER MODIFIER #2 | | | | | | | |
| Average | 26.33 | 1.735 | 1.493 | 23.10 | 9.29 | 20.84 | 0.818 |
| Std. dev. | 1.66 | 0.151 | 0.369 | 1.74 | 0.70 | 3.36 | 0.108 |
| % Difference to control | NC | NC | | NC | NC | 9.2% | |

Filter modifier number 3 of Table 4 is identical to the preferred embodiment shown in the drawings, except that it does not include cylindrical wall 10, and more significantly as regards claim 1, the apertures 33 are located closer to base shield 20, i.e., to begin at about 0.150 inches up from base shield 20. In terms of percentage of contaminate removal, filter modifier number 3 should be compared to filter modifier number 6 of Table 5. Filter modifier number 6 is identical to the most preferred embodiment filter modifier disclosed in the drawings and described herein (except that it does not include cylindrical wall 10). As can be seen by comparing the results for filter modifier number 3 with those for filter modifier number 6, the performance of filter modifier number in terms of contaminate removal is actually slightly better than that for filter modifier number 6, suggesting that it would be better to locate apertures 33 farther towards base shield 20. Indeed, such location would be well within the scope of the present invention. However, it is most preferred to locate apertures 33 farther forward on probe 30, perhaps sacrificing some contaminate removal, but making it much less likely for contaminates which collect on the interior of probe 30 to ooze out into the user's mouth. Also, locating apertures 33 forwardly on probe 30 makes it possible to reuse a given filter modifier more often, since there is more room along the interior wall of probe 30 for contaminates to build up.

Filter modifier number 4 of Table 4 is identical to filter modifier number 6 of Table 5 except that each of the three apertures 33 has been enlarged to a length of 0.1 inch and a width of 0.05 inches. Thus each aperture has an area of 0.005 square inches and the total aperture area is approximately 0.0150 square inches, well in excess of the 00135 square inch limitation of claim 1. As can be seen by reference to Table 4, the performance of filter modifier number 4 is unsatisfactory.

Filter modifier number 5 of Table 5 is identical to filter modifier number 6 of Table 5 except that each of the apertures 33 is enlarged to a round aperture with a diameter of 0.076 inches, rather than being an elongated aperture 0.075 by 0.034 inches. Thus, the area of each aperture in filter modifier number 5 was approximately 0.0045 square inches, for a total aperture area of 0.0135 square inches. As can be seen by comparing filter modifier number 5 to filter modifier number 6, filter modifier number 5 performed approximately half as effectively as filter modifier number 6. This is far better in performance than any of filter modifiers 1, 2 or 4 which had overall aperture areas of about 0.0150 square inches. However, the data suggests that the maximum total aperture area should be no more than about 0.0135 square inches.

TABLE 4

CONTROL FOR FILTER MODIFIERS #3 AND #4
2R1F
30 MM BL

| | TPM MG/C | NICO MG/C | WATER MG/C | TAR MG/C | PUFFS /C | % CO BUTT NIC MG/C | % CO BUTT NIC MG/C |
|---|---|---|---|---|---|---|---|
| Average | 24.83 | 1.535 | 1.097 | 22.41 | 9.45 | 23.82 | 0.904 |
| Std. dev. | 0.59 | 0.516 | 0.374 | 0.97 | 0.20 | 1.30 | 0.057 |
| FILTER MODIFIER #3 | | | | | | | |
| Average | 12.39 | 0.832 | 0.270 | 11.28 | 10.95 | 16.80 | 0.945 |
| Std. dev. | 4.54 | 0.300 | 0.320 | 3.96 | 0.71 | 3.36 | 0.185 |
| % Difference to control | 49.9% | 45.8% | 75.4% | 49.7% | | 29.5% | |
| FILTER MODIFIER #4 | | | | | | | |
| Average | 25.28 | 1.608 | 1.492 | 22.18 | 9.21 | 19.54 | 0.647 |
| Std. dev. | 1.69 | 0.227 | 0.703 | 1.77 | 2.12 | 4.75 | 0.084 |
| % Difference to control | NC | NC | NC | 1.0% | | 18% | |

TABLE 5

CONTROL FOR FILTER MODIFIERS #5 AND #6
2R1F
30 MM BL

| | TPM MG/C | NICO MG/C | WATER MG/C | TAR MG/C | PUFFS /C | % CO BUTT NIC MG/C | % CO BUTT NIC MG/C |
|---|---|---|---|---|---|---|---|
| Average | 26.55 | 1.838 | 2.094 | 22.62 | 9.64 | 23.11 | 0.963 |
| Std. dev. | 2.23 | 0.071 | 0.770 | 2.57 | 0.56 | 1.32 | 0.048 |
| FILTER MODIFIER #5 | | | | | | | |
| Average | 21.34 | 1.451 | 1.830 | 18.06 | 10.69 | 19.36 | 0.786 |
| Std. dev. | 5.25 | 0.305 | 0.405 | 4.59 | 0.55 | 1.98 | 0.143 |
| % Difference to control | 19.6% | 21.06% | 12.6% | 20.2% | | 16.2% | |
| FILTER MODIFIER #6 | | | | | | | |
| Average | 15.46 | 0.998 | 1.701 | 12.76 | 9.87 | 20.80 | 1.057 |
| Std. dev. | 5.41 | 0.376 | 0.244 | 5.05 | 0.66 | 2.26 | 0.154 |
| % Difference to control | 41.7% | 45.7% | 18.8% | 43.6% | | 10.0% | |

TABLE 6

CONTROL FOR FILTER MODIFIER #7
2R1F
30 MM BL

| | TPM MG/C | NICO MG/C | WATER MG/C | TAR MG/C | PUFFS /C | % CO BUTT NIC MG/C | % CO BUTT NIC MG/C |
|---|---|---|---|---|---|---|---|
| Average | 24.65 | 1.663 | 1.359 | 21.63 | 9.74 | 22.83 | 0.844 |
| Std. dev. | 0.64 | 0.152 | 0.143 | 0.48 | 0.23 | 0.82 | 0.039 |
| FILTER MODIFIER #7 | | | | | | | |
| Average | 19.06 | 1.177 | 1.111 | 15.62 | 10.16 | 20.92 | 1.039 |
| Std. dev. | 2.56 | 0.189 | 0.468 | 1.16 | 0.34 | 2.15 | 0.251 |
| % Difference to control | 22.7% | 29.2% | 18.2% | 27.8% | | 8.4% | |

Filter modifier number 7 of Table 6 is identical to filter modifier number 6, except that the overall cross-sectional area of passageway 40 is larger in filter modifier number 7. The diameter of passageway 40 in filter modifier number 6 is approximately 0.071 inches, yielding an approximate cross-sectional area of 0.004 square inches. In contrast, the diameter of passageway 40 in filter modifier number 7 was increased to approximately 0.096 inches, for a passageway cross-sectional area of about 0.008 square inches. As can be seen by comparing filter modifier number 7 to filter modifier number 6, the enlarged cross-sectional area for passageway 40 is beginning to deteriorate the modifier's performance. Filter modifier number 7 is approximately half as effective as filter modifier number 6, thus serving as an indication of the approximate upper limit required for the cross-sectional area of passageway 40.

Each of the filter modifiers 1–7 included in Tables 3–6 is different from that shown in the drawings in that it includes only a base shield and a probe rather than a base shield, probe and cylindrical wall 10 surrounding the probe and serving as a cigarette holder and mouthpiece. As a result, some smoke was able to leak around the edges of the base shield in modifiers 1–7 causing even modifier number 6, to perform somewhat less effectively than the filter modifiers tested and reported in Table 2.

In the broadest aspects of the invention as claimed, cylinder wall 10 is not required. In such an embodiment, no more than about 15% of the area of the end of filter **2*b* should be uncovered by base shield 20. At that percent, approximately 50% of the tar and nicotine which would otherwise pass through filter 2*b* is removed. When the end of filter 2*b* is 100% covered, incremental tar and nicotine removal is about 80%. The term "approximately" as used in referring to the base shield 20** being "approximately as large as the end of the cigarette filter" is intended to encompass some variation whereby not quite all of the end of the filter area, e.g., 15%, is not actually covered.

Of course, it is understood that the above is a preferred embodiment of the invention and that various changes and alterations can be made without departing from the spirit and broader aspects thereof. For example, it is understood that in the broader aspects of the invention, the device of the invention could be used in conjunction with a cigarette having no integral filter, and thus serve as a filtering device per se. Such use is contemplated in the broadest aspects of the invention, but is not the preferred use contemplated.

The embodiments of the invention in which an exclusive property or privilege is claimed are defined as follows:

1. A cigarette filter modifier comprising:

a base shield;

a probe projecting from said base shield;

at least one aperture in said probe communicating with the interior thereof, said aperture opening laterally outwardly with respect to the length of said probe, in order that smoke being drawn from a cigarette into said probe aperture is forced to turn sharply with respect to the longitudinal axis of flow of smoke through a cigarette filter in order to enter said aperture, and is forced to turn another sharp turn in order to pass down the length of said interior passage of said probe;

each said aperture being sufficiently large to facilitate draw but less than about 0.1 inch in length along the longitudinal axis of said probe and the overall aperture area being less than about 0.0135 square inches;

an interior passage in flow communication with said probe aperture and extending through the interior of said probe at least from said probe aperture to and through said base shield, said interior passage being sufficiently large in cross-section to facilitate draw but being no greater than about 0.008 square inches;

said base shield being at least approximately as large in diameter as the diameter of a cigarette filter whereby passage of smoke is blocked by said shield and smoke is forced through said probe aperture and through said interior passage when a cigarette containing said probe is drawn upon.

2. The device of claim 1 in which said probe aperture is located opposite a solid wall portion of said probe whereby tar and nicotine particles being drawn into said aperture tend to be forced against said solid wall and stick thereto.

3. The device of claim 2 wherein said probe comprises a longitudinally extending, generally cylindrical sidewall, there being three said probe apertures spaced around the circumference of said probe sidewall.

4. The device of claim 3 in which the length of each said aperture is less than about 0.075 inches along the length of said probe.

5. The device of claim 4 in which said aperture area is less than about 0.0080 square inches, and in which the overall cross-sectional area of said probe passageway is less than about 0.006 square inches.

6. The device of claim 5 in which said apertures are located adjacent the front of said probe.

7. The device of claim 1 in which said apertures are located adjacent the front of said probe.

8. The device of claim 1 in which comprises an outer cylindrical wall surrounding and being joined to said base shield and extending forwardly therefrom in the same direction as said probe to thereby surround said probe; said outer cylindrical wall having diameter sufficiently large for receiving a cigarette therein.

9. The device of claim 8 in which said outer cylindrical wall includes first and second segments of differing interior diameters, said first segment extending from the front opening of said cylindrical wall and being of a larger diameter than said second segment whereby larger diameter cigarettes can be received in said first segment and whereby narrower diameter cigarettes can be received in said second segment.

10. The device of claim 9 in which said outer cylindrical wall also extends rearwardly from said base wall in a direction opposite said probe to thereby define a mouthpiece and to recess said base wall relative to the opening defined by said mouthpiece portion of said outer cylindrical wall.

11. The device of claim 8 in which said outer cylindrical wall closely approximates the outer shape of a cigarette whereby it is not readily noticed when being used.

12. The device of claim 8 in which said outer cylindrical wall also extends rearwardly from said base wall in a direction opposite said probe to thereby define a mouthpiece and to recess said base wall relative to the opening defined by said mouthpiece portion of said outer cylindrical wall.

13. The device of claim 8 in which said outer cylindrical wall closely approximates the outer shape of a cigarette whereby it is not readily noticed when being used.

14. The device of claim 1 in which said interior passage of said probe includes a secondary filtering medium therein.

15. A filter cigarette including a tobacco portion, a conventional fiber filter portion and a modifier comprising:

a base shield;

a probe projecting from said base shield into said fiber filter portion;

at least one aperture in said probe communicating with the interior thereof and located within said fiber filter portion, said aperture opening laterally outwardly with respect to the length of said probe, in order that smoke being drawn from a cigarette into said probe aperture is forced to turn sharply with respect to the longitudinal axis of flow of smoke through a cigarette filter in order to enter said aperture, and is forced to turn another sharp turn in order to pass down the length of said interior passage of said probe;

each said aperture being sufficiently large to facilitate draw but less than about 0.1 inch in length along the longitudinal axis of said probe and the overall aperture area being less than about 0.0135 square inches;

an interior passage in flow communication with said probe aperture and extending through the interior of said probe at least from said probe aperture to and through said base shield, said interior passage being sufficiently large in cross-section to facilitate draw but being no greater than about 0.008 square inches;

said base shield being at least approximately as large in diameter as the diameter of said fiber filter portion whereby passage of smoke is blocked by said shield and is forced through said probe aperture and through said interior passage when said cigarette is drawn upon.

16. The filter cigarette of claim 15 in which said probe aperture is located opposite a solid wall portion of said probe whereby tar and nicotine particles being drawn into said aperture tend to be forced against said solid wall and stick thereto.

17. The filter cigarette of claim 16 wherein said probe comprises a longitudinally extending, generally cylindrical sidewall, and in which there are three said probe apertures spaced around the circumference of said probe sidewall.

18. The filter cigarette of claim 17 in which the length of each said aperture is less than about 0.075 inches along the length of said probe.

19. The filter cigarette of claim 18 in which said aperture area is less than about 0.0080 square inches, and in which the overall cross-sectional area of said probe passageway is less than about 0.006 square inches.

20. The filter cigarette of claim 19 in which said apertures are located adjacent the front of said probe.

21. The filter cigarette of claim 15 in which said apertures are located adjacent the front of said probe.

22. The filter cigarette of claim 15 which comprises an outer cylindrical wall surrounding and being joined to said base shield and extending forwardly therefrom in the same direction as said probe to thereby surround said probe; said outer cylindrical wall surrounding and snugly holding said fiber filter portion of said cigarette therein.

23. The filter cigarette of claim 22 in which said outer cylindrical wall also extends rearwardly from said base wall in a direction opposite said probe to thereby define a mouthpiece and to recess said base wall relative to the opening defined by said mouthpiece portion of said outer cylindrical wall.

24. The filter cigarette of claim 23 in which said outer cylindrical wall closely approximates the outer shape of a cigarette whereby it is not readily noticed when being used.

25. The filter cigarette of claim 22 in which said outer cylindrical wall closely approximates the outer shape of a cigarette whereby it is not readily noticed when being used.

26. The filter cigarette of claim 15 in which said interior passage cf said probe includes a secondary filtering medium therein.

27. A method for modifying the integral, conventional fibrous filter of a filtered cigarette comprising:

blocking the passage of smoke through the end of said filter nearest the smoker with a base shield which is at least approximately as large in diameter as the diameter of said filter;

locating a probe projecting from said base shield in said filter;

providing at least one aperture in said probe communicating with the interior thereof and locating said aperture such that it is within said filter, said aperture opening laterally outwardly with respect to the length of into said probe aperture is forced to turn sharply with respect to the longitudinal axis of flow of smoke through a cigarette filter in order to enter said aperture, and is forced to turn another sharp turn in order to pass down the length of said interior passage of said probe;

each said aperture being sufficiently large to facilitate draw but less than about 0.1 inch in length along the longitudinal axis of said probe and the overall aperture area being less than about 0.0135 square inches;

providing an interior passage in flow communication with said probe aperture and extending through the interior of said probe at least from said probe aperture to and through said base shield, said interior passage being sufficiently large in cross-section to facilitate draw but being no greater than about 0.008 square inches, whereby passage of smoke is blocked by said shield and smoke is forced through said probe aperture and through said interior passage when a cigarette containing said probe is drawn upon.

28. The method of claim 27 in which said probe aperture is located opposite a solid wall portion of said probe whereby tar and nicotine particles being drawn into said aperture tend to be forced against said solid wall and stick thereto.

29. The method of claim 28 wherein said probe comprises a longitudinally extending, generally cylindrical sidewall, there being three said probe apertures spaced around the circumference of said probe sidewall.

30. The method of claim 29 in which the length of each said aperture is less than about 0.075 inches along the length of said probe.

31. The method of claim 30 in which said overall aperture area is less than about 0.0080 square inches, and in which the overall cross-sectional area of said probe passageway is less than about 0.006 square inches.

32. The method of claim 31 in which said apertures are located adjacent the front of said probe.

33. The method of claim 27 in which said apertures are located adjacent the front of said probe.

34. The method of claim 27 which includes holding said filter in an outer cylindrical wall surrounding and being joined to said base shield and extending forwardly therefrom in the same direction as said probe to thereby surround said probe and said filter containing said probe.

35. The method of claim 34 in which said outer cylindrical wall includes first and second segments of differing interior diameters, said first segment extending from the front opening of said cylindrical wall and being of a larger diameter than said second segment whereby larger diameter cigarettes can be received in said first segment and whereby narrower diameter cigarettes can be received in said second segment.

36. The method of claim 35 which includes spacing said shield from a user's tongue by extending said outer cylindrical wall rearwardly from said base wall in a direction opposite said probe to thereby define a mouthpiece and to recess said base wall relative to the opening defined by said mouthpiece portion of said outer cylindrical wall.

37. The method of claim 36 in which said outer cylindrical wall closely approximates the outer shape of a cigarette whereby it is not readily noticed when being used.

38. The method of claim 34 which includes spacing said shield from a user's tongue by extending said outer cylindrical wall rearwardly from said base wall in a direction opposite said probe to thereby define a mouthpiece and to recess said base wall relative to the opening defined by said mouthpiece portion of said outer cylindrical wall.

39. The method of claim 34 in which said outer cylindrical wall closely approximates the outer shape of a cigarette whereby it is not readily noticed when being used.

40. The method of claim 27 in which said interior passage of said probe includes a secondary filtering medium therein.

* * * * *

UNITED STATES PATENT AND TRADEMARK OFFICE

CERTIFICATE OF CORRECTION

PATENT NO. : 4,877,040

DATED : October 31, 1989

INVENTOR(S) : Donald Jansma and Howard W. Stemm

It is certified that error appears in the above-identified patent and that said Letters Patent is hereby corrected as shown below:

Column 1, Line 20:

After "filter" insert --.--

Column 5, Line 7:

"of-the" should be --of the--

Column 6, Line 18:

After "filters" insert --.--

Column 10, Line 29:

"00135" should be --0.0135--

Column 15, Line 26:

After "length of" insert --said probe, in order that smoke being drawn from a cigarette--

Signed and Sealed this

Sixteenth Day of April, 1991

*Attest:*

HARRY F. MANBECK, JR.

*Attesting Officer*

*Commissioner of Patents and Trademarks*